US006248184B1

(12) United States Patent
Dull et al.

(10) Patent No.: US 6,248,184 B1
(45) Date of Patent: Jun. 19, 2001

(54) USE OF RARE EARTH METAL SALT SOLUTIONS FOR SEALING OR ANODIZED ALUMINUM FOR COROSION PROTECTION AND PAINT ADHESION

(75) Inventors: Dennis L. Dull, Sumner, WA (US); Florian B. Mansfeld, Santa Monica, CA (US)

(73) Assignees: The Boeing Company, Seattle, WA (US); University of Southern California, Los Angeles, CA (US)

( * ) Notice: Subject to any disclaimer, the term of this patent is extended or adjusted under 35 U.S.C. 154(b) by 0 days.

(21) Appl. No.: 09/076,310

(22) Filed: May 11, 1998

Related U.S. Application Data

(60) Provisional application No. 60/046,234, filed on May 12, 1997.

(51) Int. Cl.[7] ..... C23C 22/56; C23C 28/00; C04B 9/02; C09K 3/00; B05D 1/36

(52) U.S. Cl. ..... 148/275; 148/272; 148/273; 106/14.05; 106/14.21; 252/387; 205/183; 427/419.1

(58) Field of Search ..... 148/272, 275, 148/273; 106/14.05, 14.21; 252/387; 205/183; 427/419.1

(56) References Cited

U.S. PATENT DOCUMENTS

| | | | | |
|---|---|---|---|---|
| 2,512,493 | * | 6/1950 | Gide | 148/247 |
| 3,897,287 | | 7/1975 | Meyer et al. | 156/22 |
| 4,992,115 | * | 2/1991 | Ikeda | 148/247 |
| 5,192,374 | | 3/1993 | Kindler | 148/272 |
| 5,194,138 | | 3/1993 | Mansfeld et al. | 205/183 |
| 5,322,560 | * | 6/1994 | DePue et al. | 106/404 |
| 5,356,492 | | 10/1994 | Miller | 148/273 |
| 5,362,335 | | 11/1994 | Rungta | 148/272 |
| 5,582,654 | | 12/1996 | Mansfeld et al. | 148/273 |
| 5,635,084 | * | 6/1997 | Mansfield | 216/106 |

FOREIGN PATENT DOCUMENTS

WO 88/06639 9/1988 (WO) .

WO 95/08008 3/1995 (WO) .

OTHER PUBLICATIONS

"Sealing of Boric–Sulfuric Anodized Aluminum Alloys in Rare Earth Metal Salt Solutions " Florian Mansfeld et al.; Corrosion & Environmental effects Laboratory (CEEL) Presentation dated May 12–15, 1996; University of So. California.

"Sealing of Boric–Sulfuric Anodized Aluminum Alloys in Rare Earth Metal Salt Solutions —Part II" Florian Mansfeld et al.; Corrosion & Environmental effects Laboratory (CEEL) Presentation dated May 12–15, 1996; University of So. California.

"Evaluation of Sealing Methods for Anodized Aluminum Alloys with Electrochemical Impedance Spectroscopy (EIS)" Florian Mansfeld et al.; Corrosion & Environmental effects Laboratory (CEEL) Presentation dated May 12–15, 1996; University of So. California.

* cited by examiner

*Primary Examiner*—Cynthia Harris Kelly
*Assistant Examiner*—Monique T. Cole
(74) *Attorney, Agent, or Firm*—Paul C. Cullom, Jr.

(57) ABSTRACT

A process for sealing the surface coating formed by anodizing an aluminum or aluminum alloy substrate (for example, aerospace, commercial, and architectural products), the process including the steps of:

(a) providing an aluminum or aluminum alloy substrate with a surface coating formed thereon by anodizing the aluminum or aluminum alloy substrate;

(b) providing a sealing solution comprising a dilute solution of a rare earth metal salt selected from the group consisting of cerium salts and yttrium salts; and (c) contacting the substrate with the sealing solution for a sufficient amount of time to seal the surface coating on the substrate. Also disclosed is a chemical sealing solution for sealing the surface coating formed by anodizing an aluminum or aluminum alloy substrate, the solution being a dilute solution of a rare earth metal salt selected from the group consisting of cerium salts and yttrium salts.

6 Claims, No Drawings

USE OF RARE EARTH METAL SALT SOLUTIONS FOR SEALING OR ANODIZED ALUMINUM FOR COROSION PROTECTION AND PAINT ADHESION

CROSS-REFERENCE TO RELATED APPLICATIONS

This application claims the benefit of U.S. provisional application Ser. No. 60/046,234 filed on May 12, 1997.

BACKGROUND OF THE INVENTION

This environmental-quality invention is in the field of sealing the surface coatings produced by anodizing aluminum and aluminum alloy substrates (for example, aerospace, commercial, and architectural products). The invention produces sealed anodization coatings exhibiting good corrosion resistance performance while maintaining acceptable levels of paint adhesion performance.

The International Agency for Research on Cancer has identified both chromium and nickel compounds along with many other pollutants as confirmed human carcinogens. The Boeing Company (Boeing), along with many other companies, has voluntarily agreed with the U.S. Environmental Protection Agency (EPA) to reduce the use of the seventeen most hazardous pollutants which include these compounds. Currently, the only approved sealing solution for the coating produced by the boric acid-sulfuric acid anodizing process is a dilute (45–75 ppm) chromate seal solution. The purpose of the chromate sealing solution is to hydrate surface oxide while entrapping the hexavalent chromium. The hexavalent chromium acts as a corrosion inhibitor to further enhance the corrosion resistance of the anodized coating. Using this dilute chromate seal solution, production operations can use the boric acid-sulfuric acid anodizing process on aluminum alloys 2024, 6061, and 7075 and produce parts that pass a two-week salt spray test and meet the requirements for paint adhesion. Unfortunately, the dilute chromate sealing solution is a hazardous pollutant.

The unsealed aluminum oxide produced by anodizing is usually modeled as two oxide layers on an aluminum substrate. The inner layer is a thin continuous barrier layer of less than 500 angstroms thickness. The outer layer is a discontinuous coating with pores that may penetrate from the outside surface to the barrier layer. These pores are the source of potential corrosion pitting problems that occur in salt spray and other atmospheric environments. In the dilute chromate seal solution process, these aluminum oxide pores are hydrated with entrapped hexavalent chromium. This filling of the pores enhances the corrosion protection of the anodized coating on the aluminum substrate.

In B. Yaffe, Metal Finishing, May 1990, vol. 41 (1990), the author reviews the known methods of sealing anodized aluminum, such as sealing in steam and hot water, nickel acetate, dichromate, and various cold sealing methods. Some of the newer sealing methods have been developed due to environmental concerns and the desire to lower costs. Cold sealing in nickel fluoride has been introduced to lower these costs. However, health hazards have been observed recently for nickel salts, which can cause allergic contact dermatitis. In NASA Tech Briefs, May 1995, a sulfuric acid anodizing process with a lower temperature nickel acetate seal is described. This process produces thin anodized layers that are not detrimental to the fatigue properties of the aluminum substrate, but does not address the health hazards due to the use of nickel salts. In Boeing's boric acid-sulfuric acid anodizing process, anodized layers of about 1 $\mu$m thickness are produced, which are then sealed using a dilute chromate solution (as described in Boeing Process Specification BAC 5632, "Boric Acid-Sulfuric Acid Anodizing").

In a study to develop an overall corrosion protection system for aluminum alloys, co-inventor Mansfeld developed a treatment for commercial aluminum alloys using two rare earth metal salt solutions that produced surfaces with excellent resistance to pitting (see Mansfeld et al. U.S. Pat. No. 5,194,138, "Method For Creating A Corrosion-Resistant Aluminum Surface"). For commercial aluminum alloys having a high copper content, co-inventor Mansfeld developed an additional pre-treatment to remove copper from the outer surface to further enhance corrosion protection (see Mansfeld et al. U.S. Pat. No. 5,582,654, "Method For Creating A Corrosion-Resistant Surface On Aluminum Alloys Having A High Copper Content").

BRIEF SUMMARY OF THE INVENTION

In one aspect, the invention is a process for sealing the surface coating formed by anodizing an aluminum or aluminum alloy substrate (for example, aerospace, commercial, and architectural products), the process including the steps of:

(a) providing an aluminum or aluminum alloy substrate with a surface coating formed thereon by anodizing the aluminum or aluminum alloy substrate;

(b) providing a sealing solution comprising a dilute solution of a rare earth metal salt selected from the group consisting of cerium salts and yttrium salts; and (c) contacting the substrate with the sealing solution for a sufficient amount of time to seal the surface coating on the substrate.

In another aspect, the invention is a chemical sealing solution for sealing the surface coating formed by anodizing an aluminum or aluminum alloy substrate, the solution being a dilute solution of a rare earth metal salt selected from the group consisting of cerium salts and yttrium salts.

DETAILED DESCRIPTION OF THE INVENTION

The rare earth metal salt sealing solutions described herein provide an alternative to the commonly-used chromate-type seal solutions for the boric-sulfuric acid anodizing process, for the sulfuric acid anodizing process, and for the chromic acid anodizing process. These rare earth metal salt sealing solutions contain low toxicity materials that may be disposed of easily.

Aluminum alloys anodized by the boric acid-sulfuric acid anodizing process and then sealed with a rare earth metal salt sealing solution meet the same performance requirements called out for these alloys when sealed using a dilute chromate seal solution. These tests include the salt-spray test conducted in accordance with ASTM B117 ("Standard Test Method of Salt Spray (Fog) Testing") and the paint adhesion test conducted in accordance with Boeing Support Standard BSS 7225 ("Adhesion, Tape Test"). Test panels of aluminum alloys 6061 and 7075 passed the 336-hour salt spray test with less than one pit per 10 sq. in., which is the passing criterion. Test panels of aluminum alloy 2024 require further optimization since they had about two pits per 10 sq. in. Test panels of anodized aluminum alloys 2024, 6061, and 7075 sealed with rare earth metal salt sealing solutions and then sprayed with a paint qualified under Boeing Material Standard BMS 10-11 ("Chemical and Solvent Resistant Finish") passed the dry adhesion, 24-hour wet adhesion, and sevenday adhesion tests. There was no primer lift off from any panel in any of the three adhesion tests although up to 1/32 in. primer lift off beyond the scribe is acceptable.

The objective of this invention is to replace the current dilute chromate sealing solution with an equivalent-performing or better non-chromate seal solution using either a similar or an alternative inhibitive approach and chemical substances that are not currently or foreseen to be listed as toxic by the EPA. Also, our objective is to minimize upset to the current boric acid-sulfuric acid anodizing process by providing a seal whereby parts need not be sorted due to alloy composition.

We conducted research to evaluate rare earth metal salt sealing solutions such as cerium salts, yttrium salts, and others as a replacement to the currently successful dilute chromate seal solution used for sealing the coatings produced by the boric acid-sulfuric acid anodizing process. More specifically, we included:

yttrium acetate, yttrium sulfate, yttrium chloride, cerium nitrate, cerium acetate, cerium sulfate, nickel fluoride (a European standard), boiling water, and dilute chromate seal solution as our standard. The aluminum alloys included 2024, 6061 and 7075. The test methods included electrochemical impedance spectroscopy (EIS) and optical microscopy examination at 30× of the panels after immersion in 0.5N NaCl solutions.

Sealing Process

The sealing process for an anodized aluminum alloy part is as follows:

Sealing: Immerse parts in the sealing solution at the specified temperature for the prescribed period of time.

EXAMPLE 1

Panels (4 in.×6 in.) of aluminum alloys 2024, 6061, 7075 were coated in accordance with the boric acid-sulfuric acid anodizing process as described in Boeing Process Specification BAC 5632, "Boric Acid-Sulfuric Acid Anodizing". Then a 50 mM cerium nitrate sealing solution (mM is the abbreviation for millimolar) was prepared by dissolving the cerium nitrate salt in distilled water and adjusting to pH 6 using nitric acid at room temperature. The solution was heated to the boiling temperature which is approximately 100° C. Panels were immersed in the sealing solution for 30 minutes.

EXAMPLE 2

Panels (4 in.×6 in.) of aluminum alloys 2024, 6061, 7075 were coated in accordance with the boric acid-sulfuric acid anodizing process as described in Boeing Process Specification BAC 5632, "Boric Acid-Sulfuric Acid Anodizing". Then a 50 mM yttrium sulfate sealing solution was prepared by dissolving the yttrium sulfate salt in distilled water and adjusting to pH 6 using nitric acid at room temperature. The solution was heated to the boiling temperature which is approximately 100° C. Panels were immersed in the sealing solution for 30 minutes.

EXAMPLE 3

Panels (4 in.×6 in.) of aluminum alloys 2024, 6061, 7075 were coated in accordance with the boric acid-sulfuric acid anodizing process as described in Boeing Process Specification BAC 5632, "Boric Acid-Sulfuric Acid Anodizing". Then a 50 mM cerium sulfate sealing solution was prepared by dissolving the cerium sulfate salt in distilled water and adjusting to pH 5.5 using nitric acid at room temperature. The solution was heated to the boiling temperature which is approximately 100° C. Panels were immersed in the sealing solution for 15 minutes.

EXAMPLE 4

Panels (3 in.×3 in.) of aluminum alloys 2024 and 6061 were coated in 15 wt. pct. sulfuric acid. Then a saturated cerium acetate sealing solution was prepared by dissolving cerium acetate salt in distilled water as described by Mansfeld et al., Plating and Metal Finishing, December 1997, vol. 84 (1997). The solution was heated to boiling temperature which is approximately 100° C. Panels were immersed in the sealing solution for 40 minutes. After sealing, the panels were rinsed with deionized water and air dried.

EXAMPLE 5

Panels (3 in×3 in.) of aluminum alloy 6061 were coated in 15 wt. pct. sulfuric acid. Then a saturated cerium acetate sealing solution was prepared by dissolving cerium acetate salt in distilled water as described by Mansfeld et al., Plating and Metal Finishing, December 1997, vol. 84 (1997). The solution was heated to approximately 80–85° C. Panels were immersed in the sealing solution for 40 minutes. After sealing, the panels were rinsed with deionized water and air dried.

EXAMPLE 6

Panels (3 in.×3 in.) of aluminum alloy 7075 were coated in 15 wt. pct. sulfuric acid. Then a saturated cerium acetate sealing solution was prepared by dissolving cerium acetate salt in distilled water as described by Mansfeld et al., Plating and Metal Finishing, December 1997, vol. 84 (1997). The solution was heated to approximately 80–85° C. Panels were immersed in the sealing solution for 20 minutes. After sealing, the panels were rinsed with deionized water and air dried.

EXAMPLE 7

Panels (3 in.×3 in.) of aluminum alloy 2024 were coated in 15 wt. pct. sulfuric acid. Then a saturated cerium acetate sealing solution was prepared by dissolving cerium acetate salt in distilled water as described by Mansfeld et at., Plating and Metal Finishing, December 1997, vol. 84 (1997). The solution was heated to approximately 80–85° C. Panels were immersed in the sealing solution for 20 minutes. After sealing, the panels were rinsed with deionized water and air dried.

Rinsing: Remove parts from the sealing solution, water immersion rinse at 50° C. for five minutes, followed by subsequent rinse at room temperature for five minutes.

Driving: Dry sample with dry oil-free air.

Chemical Concentration, pH, Temperature, And Immersion Time

The chemical concentration of the dissolved rare earth metal salt in the sealing solution may be from about 10 mM to about 350 mM. The pH of the sealing solution may be from about 3.0 to about 9.0. The temperature of the sealing solution may be from about 60° C. to the boiling temperature of the sealing solution. The immersion time in the sealing solution may be from about 10 minutes to about 60 minutes.

Results of Electrochemical Impedance Spectroscopy (EIS) and Optical Microscopy At 3×

Numerous electrochemical impedance spectroscopy (EIS) runs were performed to generate Bode plots (logarithm impedance versus logarithm frequency; phase angle versus logarithm frequency) that include work on panels of sealed and unsealed coatings made by the boric acid-sulfuric acid anodizing process. At the end of testing, the panels were examined at 30× magnification to determine the number of pits and to size the pits as either small or large. From these data, we selected yttrium sulfate, cerium nitrate, and cerium sulfate sealing solutions as the more promising candidates. The selected rare earth metal salt sealing solutions were evaluated in corrosion and adhesion testing.

Results of Corrosion Testing

Duplicate 4 in.×6 in. salt spray panels of alloys 2024, 6061, and 7075 with a coating produced by the boric acid-sulfuric acid anodizing process were sealed with cerium nitrate, yttrium sulfate, and cerium sulfate, as in the above sealing process Examples 1, 2, and 3, respectively. After 336 hours of salt spray testing, the panels were visually examined. The passing criterion is that there shall be no more than five pits on a 3 in.×10 in. panel or more than nine pits in 90 square inches of test area. The pit density shall not exceed one pit per 10 sq. in. All alloy 6061 and alloy 7076 panels had one or no pits on the 24 sq. in. surface. The alloy 2024 panels with yttrium sulfate and cerium nitrate seal had about five pits per panel, which is about two pits per 10 sq. in. The alloy 2024 panel with cerium sulfate had multiple pits.

Results Of Paint Adhesion Testing

Panels of alloys 2024, 6061, and 7075 with a coating produced by the boric acid-sulfuric acid anodizing process were sealed with yttrium sulfate, cerium nitrate, and cerium sulfate, as in the above sealing process Examples 1, 2, and 3, respectively. Each panel was sprayed with one coat of a paint (manufactured by Deft) qualified under Boeing Material Specification BMS 10-11, Grade E, and allowed to cure at room temperature for seven days. Testing included: dry adhesion, 24 hour wet adhesion, and 7 day wet adhesion. The passing criterion in the scribe area is that there shall be no paint lift off 1/32 in. beyond the scribe after the tape adhesion test. The test results showed no paint lift off from any panel. The three alloys each sealed with the three different seal solutions all passed the paint adhesion test.

The patents, specifications, and other publications referenced above are incorporated herein by reference.

As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative and not restrictive. The scope of the present invention is as set forth in the appended claims rather than being limited to the examples set forth in the foregoing description. Any and all equivalents are intended to be embraced by the claims.

What is claimed is:

1. A chemical sealing solution for sealing the surface coating formed by anodizing an aluminum or aluminum alloy substrate, said sealing solution consisting of a dilute solution of a rare earth metal salt selected from the group consisting of cerium salts and yttrium salts, wherein the chemical concentration of said dilute solution of a rare earth metal salt in said sealing solution is from about 10 mM to about 350 mM.

2. The chemical sealing solution of claim 1 wherein said sealing solution consists of a dilute solution of cerium salts.

3. The chemical sealing solution of claim 1 wherein said sealing solution consists of a dilute solution of yttrium salts.

4. The chemical sealing solution of claim 1 wherein said sealing solution consists of a dilute solution of a rare earth metal salt selected from the group consisting of cerium nitrate, yttrium sulfate, and cerium sulfate.

5. The chemical sealing solution of claim 1 wherein the pH of said sealing solution is from about 3.0 to about 9.0.

6. The chemical sealing solution of claim 1 wherein the temperature of said sealing solution is from about 60° C. to the boiling temperature of the sealing solution.

* * * * *